US005342719A

United States Patent [19]

Pai et al.

[11] Patent Number: 5,342,719

[45] Date of Patent: Aug. 30, 1994

[54] IMAGING MEMBERS HAVING A HYDROXY ARYL AMINE CHARGE TRANSPORT LAYER

[75] Inventors: Damodar M. Pai, Fairport; John F. Yanus, Webster; Paul J. DeFeo, Sodus Point, all of N.Y.; Alan E. J. Toth, Burlington, Canada; Walter Mychajlowskij, Georgetown, Canada; Zoran Popovic, Mississauga, Canada

[73] Assignee: Xerox Corporation, Stamford, Conn.

[21] Appl. No.: 24,127

[22] Filed: Mar. 1, 1993

[51] Int. Cl.[5] ..... G03G 5/05

[52] U.S. Cl. ..... 430/59; 430/73

[58] Field of Search ..... 430/58, 59

[56] References Cited

U.S. PATENT DOCUMENTS 4,943,501 7/1990 Kinoshita et al. ..... 430/59

4,988,595 1/1991 Pai et al. ..... 430/59

*Primary Examiner*—John Goodrow

*Attorney, Agent, or Firm*—E. O. Palazzo

[57] ABSTRACT

An electrophotographic imaging member including a charge generating layer, a charge transport layer with charge transport molecules and as sensitizing additive or dopant a hydroxy derivative of the transport molecule.

25 Claims, No Drawings

IMAGING MEMBERS HAVING A HYDROXY ARYL AMINE CHARGE TRANSPORT LAYER

BACKGROUND OF THE INVENTION

This invention relates generally to electrophotographic imaging members, and more specifically, to photoconductive imaging members with improved sensitivity characteristics obtained, for example, by the addition to the charge transport layer of hydroxy derivatives of charge transport molecules.

Electrophotographic photoreceptors are known and typically include a photoconductive layer formed on a conductive substrate. The photoconductive layer can be considered an insulator in the dark thus electric charges can be retained on its surface, however, upon exposure to light the charge is dissipated.

A latent image is formed on the photoreceptor by first uniformly depositing electric charges over the surface of the photoconductive layer by one of any means known in the art. The photoconductive layer acts as a charge storage capacitor with charge on its free surface and an equal charge of opposite polarity or countercharge on the conductive substrate. A light image is then projected onto the photoconductive layer. On those portions of the photoconductive layer that are exposed to light, the electric charge is conducted through the layer reducing the surface charge. The portions of the photoconductive surface not exposed to light retain their surface charge with the quantity of electric charge at any particular area of the photoconductive surface is inversely related to the illumination incident thereon, thus forming a latent electrostatic image.

The photodischarge of the photoconductive layer usually requires this layer to photogenerate conductive charge and to transport this charge through the layer thereby neutralizing the charge on the surface. Two types of photoreceptor structures have been employed: multilayer structures wherein separate layers perform the functions of charge generation and charge transport, respectively, and single layer photoconductors which perform both functions. These layers are laminated onto a conducting substrate and may include an optional charge blocking and an adhesive layer between the conducting and the photoconducting layers. Additionally, the substrate may be comprised of a nonconducting mechanical support with a conductive layer. Other layers to provide special functions, such as incoherent reflection of laser light, dot patterns for pictorial imaging or subbing layers to provide chemical sealing and/or a smooth coating surface, may be employed.

An example of a photoreceptor is a multilayered device comprised of a conductive layer, a blocking layer, an adhesive layer, a charge generating layer, and a charge transport layer. The charge transport layer can contain an active aromatic diamine molecule, which enables charge transport, dissolved or molecularly dispersed in a film forming binder. This type of charge transport layer is described, for example, in U.S. Pat. No. 4,265,990, the disclosure of which is totally incorporated herein by reference. Other known charge transport molecules include a variety of electron donor, aromatic amines, oxadiazoles, oxazoles, hydrazones and stilbenes for hole transport and electron acceptor molecules for electron transport. Another type of charge transport layer has been developed which utilizes a charge transporting polymer wherein the charge transporting moiety is incorporated in the polymer as a pendant or may form the backbone of the polymer. This type of charge transport polymer includes materials, such as poly(N-vinylcarbazole), polysilylenes, and others, including those described in U.S. Pat. Nos. 4,618,551; 4,806,443; 4,806,444; 4,818,650; 4,935,487 and 4,956,440, the disclosures of which are totally incorporated herein by reference.

Charge generator layers employed include amorphous films of selenium and alloys of selenium and arsenic, tellurium, germanium and the like; hydrogenated amorphous silicon and compounds of silicon and germanium, carbon, oxygen, nitrogen and the like, fabricated by vacuum evaporation or deposition; inorganic pigments of crystalline selenium and its alloys, III-V and II-VI compounds and organic pigments such as quinacridones, metal phthalocyanines, metal free phthalocyanines, polycyclic pigments such as dibromo anthranthrone pigments, perylene and perinone diamines, polynuclear aromatic quinones, azo pigments including bis-, tris- and tetrakis-azos, and the like dispersed in a film forming polymeric binder and fabricated by solvent coating.

Phthalocyanines have been employed as photogenerating materials for use in laser printers with infrared exposures. Infrared sensitivity is believed needed for low cost semiconductor laser diodes used as the light exposure source. Many metal phthalocyanines have been reported and include oxyvanadium phthalocyanine, chloroaluminum phthalocyanine, copper phthalocyanine, oxytitanium phthalocyanine, chlorogallium phthalocyanine, magnesium phthalocyanine and metal-free phthalocyanine.

One of the design criteria in the selection of the pigment for the generator layer and the selection of charge transporting molecule in the transport layer is that when light photons photogenerate holes in the pigment they be efficiently injected into the transporting molecule in the transport layer, that is, the injection efficiency from the pigment to the transport layer should be high. A second design criterion is that the injected holes be transported across the transport layer in a short time; shorter, for example, than the time duration between the exposure and development stations. The transit time across the transport layer can be determined by the charge carrier mobility in the transport layer, which charge carrier mobility is the velocity per unit field and has dimensions of $cm^2$/volt second. The charge carrier mobility is primarily a function of the structure of the charge transporting molecule, it's concentration in the transport layer and the "inactive" binder polymer in which the charge transport molecule is dispersed. It is believed that the injection efficiency can be maximized by selecting a transport molecule whose ionization potential is lower than that of the pigment, however, low ionization potential molecules may have other deficiencies, one of which is their instability in an atmosphere of corona effluents. Therefore, the sensitivity of the layered devices is primarily determined by three factors: (1) photogeneration efficiency; (2) injection efficiency from the pigment into the transporting medium surrounding it; and (3) the transport of the carriers through the transport layer. Pigments can be classified into: (1) intrinsic and (2) extrinsic. With intrinsic pigments, the charge transporting molecule which surrounds the pigment is not involved in the photogeneration step, while with extrinsic pigments, in the absence of the charge transporting molecule, the photogeneration efficiency is small; in the presence of the charge transport molecule, the photogeneration efficiency is higher. With a given pigment and a charge transport molecule, several factors enter into optimizing the sensitivity of the layered devices of the prior art, including: (1) pigment concentration and thickness of the generator layer; (2) the binder polymer in which the pigments are dispersed; (3) the procedure of milling, and the like employed to prepare the generator slurry; and (4) the transport layer thickness. The generator layer binder selection is also based on the ability to obtain dispersions and is sometimes selected on the basis of its manufacturability. Higher sensitivities can result in reduced laser power requirements and provide for an increase in the throughput of the xerographic process.

With the present invention, in embodiments significant increase, by as much as a factor 2, in sensitivity can be realized by the doping of the transport layer with, for example, small effective concentrations of transport molecules containing hydroxy groups, and other advantages can be achieved as indicated herein.

SUMMARY OF THE INVENTION

It is, therefore, an object of the present invention to provide an improved electrophotographic imaging member with high sensitivities.

It is another object of the present invention to provide an electrophotographic imaging member with increased sensitivity achieved by transport layer doping.

It is another object of the present invention to provide an electrophotographic imaging member in which the transport layer is doped with a molecule which has hydroxy groups.

Another object of the present invention resides in the provision of liquid imaging members of the type as illustrated in U.S. Pat. No. 4,265,990, the disclosure of which is totally incorporated herein by reference, wherein the charge transport layer is doped with a dihydroxy aryl amine, and wherein the injection of charge from the photogenerating layer is increased, especially for phthalocyanines such as vanadyl phthalocyanines.

These and other objects are accomplished in accordance with this invention by providing an electrophotographic imaging member comprising a generator layer, and a charge transport layer, wherein the generator layer contains a dispersion of pigments in a binder, and the transport layer contains a charge transporting component dispersed in an "inactive" binder, and wherein the transport layer is doped with a molecule containing hydroxy groups. These devices may include optional charge blocking, adhesive, subbing layers and an overcoat layer. With photoconductor belts, there can be included an anticurl layer on the supporting substrate.

The embodiments of the present invention include an imaging member comprising a supporting substrate, a photogenerating layer and a charge transport layer, said charge transport layer comprising charge transporting molecules dispersed in a polymeric binder and wherein said transport layer contains a hydroxy derivative of said charge transport molecules; and a method of imaging which comprises generating an electrostatic latent image on the aforementioned imaging member, developing the latent image, and transferring the developed electrostatic image to a suitable substrate. Imaging members of the present invention may be prepared by various suitable techniques. Typically, a flexible or rigid substrate is provided having an electrically conductive surface. A charge generating layer is then applied to the electrically conductive surface, and a charge blocking layer may be applied to the electrically conductive surface prior to the application of the charge generating layer, and an adhesive layer may be utilized between the charge blocking layer and the charge generating layer. Usually the charge generation layer is applied onto the blocking layer and a charge transport layer is formed thereover. The charge generation layer can be situated on top of or below the charge transport layer.

The substrate may be opaque or substantially transparent and may comprise numerous suitable materials having the required mechanical properties. Accordingly, the substrate may comprise a layer of an electrically nonconductive or conductive material such as an inorganic or an organic composition. As electrically nonconducting materials, there may be employed various resins known for this purpose including polyesters, polycarbonates, polyamides, polyurethanes, and the like, which are flexible as thin webs. The electrically conducting substrate may be comprised of any effective metal, for example aluminum, nickel, steel, copper, and the like, a polymeric material filled with a conducting substance, such as carbon, metallic powder, and the like, or an organic conducting material. The electrically insulating or conductive substrate may be in the form of an endless flexible belt, a web, a rigid cylinder, a sheet and the like.

The thickness of the substrate layer depends on numerous factors, including the strength desired and economical considerations. Thus, this layer for a drum may be of substantial thickness, up to centimeters for example, or of minimum thickness less than a millimeter. Similarly, a flexible belt may be of substantial thickness, for example about 250 micrometers, or of minimum thickness less than 50 micrometers, provided there are no adverse effects on the final electrophotographic device. The surface of the substrate layer is preferably cleaned prior to coating to promote greater adhesion of the deposited coating. Cleaning may be effected, for example, by exposing the surface of the substrate layer to plasma discharge, ion bombardment, solvents, etchents and the like.

When the substrate layer is not conductive, a separate electrically conductive layer can be selected. The conductive layer may vary in thickness over substantially wide ranges depending on the optical transparency, degree of flexibility desired for the member, and economic factors. Accordingly, for a flexible photoresponsive imaging device, the thickness of the conductive layer may be between about 20 Angstroms to about 750 Angstroms, and more preferably from about 100 Angstroms to about 200 Angstroms for an optimum combination of electrical conductivity, flexibility and light transmission. The flexible conductive layer may be an electrically conductive metal layer formed, for example, on the substrate by any suitable coating technique, such as a vacuum depositing technique or electrodeposition. Typical metals include aluminum, zirconium, niobium, tantalum, vanadium and hafnium, titanium, nickel, stainless steel, chromium, tungsten, molybdenum, and the like. In general, a continuous metal film can be attained on a suitable substrate like a polyester web substrate, such as MELINEX® available from E.I. DuPont de Nemours & Company, with magnetron sputtering.

If desired, an alloy of suitable metals may be deposited on a substrate. Typical metal alloys may contain two or more metals such as zirconium, niobium, tantalum, vanadium and hafnium, titanium, nickel, stainless steel, chromium, tungsten, molybdenum, and the like, and mixtures thereof. A typical electrical conductivity for conductive layers for electrophotographic imaging members in slow speed copiers is about $10^2$ to $10^3$ ohms/square.

Any suitable polymeric film forming binder material may be employed as the matrix in the photogenerating binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloridevinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in various amounts, generally, however, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment, about 8 percent by volume of the photogenerating pigment is dispersed in about 92 percent by volume of the resinous binder composition. The photogenerator layers can also be fabricated by vacuum sublimation with no binder. The pigment in the generator layer is preferably a phthalocyanine in embodiments. Many useful metal phthalocyanines can be selected, examples of which include oxyvanadium phthalocyanine, chloroaluminum phthalocyanine, copper phthalocyanine, oxytitanium phthalocyanine, chlorogallium phthalocyanine, magnesium phthalocyanine and metal-free phthalocyanine. The phthalocyanines exist in many crystal forms which may have a strong influence on photogeneration. Other photogenerating pigments are known and include vanadyl phthalocyanines, squaraines, bisazos, titanyl phthalocyanines, and the like.

Any suitable and conventional techniques may be utilized to mix and thereafter apply the photogenerating layer coating. Typical application techniques include spraying, dip coating, roll coating, wire wound rod coating, vacuum sublimation and the like. For some applications, the generator layer is fabricated in a dot or line pattern. Removing the solvent of a solvent coated layer may be effected by any suitable conventional technique such as oven drying, infrared radiation drying, air drying and the like.

The charge transport layer comprises charge transporting small molecule dissolved or molecularly dispersed in a film forming inert polymer such as a polycarbonate. The charge transport layer may also be fabricated from a charge transporting polymer comprising charge transporting moieties in the backbone of the film forming charge transporting polymer. Any suitable charge transporting or electrically active small molecule may be employed in the charge transport layer of this invention. Typical charge transporting small molecules include, for example, pyrazolines, diamines, hydrazones, oxadiazoles, triphenyl methanes stilbenes and the like. Hole transport molecules of the type described in U.S. Pat. Nos. 4,306,008; 4,304,829; 4,233,384; 4,115,116; 4,299,897; 4,081,274, and 5,139,910, the disclosures of each of which are totally incorporated herein by reference, can be selected for the imaging members of the present invention. Typical diamine hole transport molecules include N,N'-diphenyl-N,N'-bis(3-methylphenyl)-(1,1'-biphenyl)-4,4'-diamine, N,N'-diphenyl-N,N'-bis(4-methylphenyl)-(1,1'-biphenyl)-4,4'-diamine, N,N'-diphenyl-N,N'-bis(2-methylphenyl)-(1,1'-biphenyl)-4,4'-diamine, N,N'-diphenyl-N,N'-bis(3-ethylphenyl)-(1,1'-biphenyl)-4,4'-diamine, N,N'-diphenyl-N,N'-bis(4-ethylphenyl)-(1,1'-biphenyl)-4,4'-diamine, N,N'-diphenyl-N,N'-bis(4-n-butylphenyl)-(1,1'-biphenyl)-4,4'-diamine, N,N'-diphenyl-N,N'-bis(3-chlorophenyl)-[1,1'-biphenyl]-4,4'-diamine, N,N'-diphenyl-N,N'-bis(4-chlorophenyl)-[1,1'-biphenyl]-4,4'-diamine, N,N'-diphenyl-N,N'-bis(phenylmethyl)-[1,1'-biphenyl]-4,4'-diamine,N,N,N',N'-tetraphenyl-[2,2'-dimethyl-1,1'-biphenyl]-4,4'-diamine, N,N,N',N'-tetra-(4-methylphenyl)-[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl)-[2,2'-dimethyl-1,1'-biphenyl]-4,4'-diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, and the like.

Pyrazoline transport molecules as disclosed in U.S. Pat. Nos. 4,315,982; 4,278,746 and 3,837,851, the disclosures of each of which are totally incorporated herein by reference, can also be selected. Typical pyrazoline transport molecules include 1-[lepidyl-(2)]-3-(p-diethylaminophenyl)-5-(p-diethylaminophenyl)pyrazoline, 1-[quinolyl-(2)] 3-(p-diethylaminophenyl)-5-(p-diethylaminophenyl)pyrazoline, 1-[pyridyl-(2)]-3-(p-diethylaminostyryl)-5-(p-diethylaminophenyl)pyrazoline, 1-[6-methoxypyridyl-(2)]-3-(p-diethylaminostyryl)-5-(p-diethylaminophenyl)pyrazoline, 1-phenyl-3-[p-dimethylaminostyryl]-5-(p-dimethylaminostyryl)pyrazoline, 1-phenyl-3-[p-diethylaminostyryl]-5-(p-diethylaminostyryl)pyrazoline, 2-nitro-9-(4'-diethylaminobenzylidene)fluorene, and the like.

Oxadiazole transport molecules such as 2,5-bis(4-diethylaminophenyl)-1,3,4-oxadiazole, pyrazoline, imidazole, triazole, and the like. Other typical oxadiazole transport molecules are described, for example, in German Patents 1,058,836; 1,060,260 and 1,120,875, the disclosures of each of which are totally incorporated herein by reference, can also be selected.

Other specific hole transports include: hydrazone transport molecules, such as p-diethylamino benzaldehyde-(diphenylhydrazone), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde-(diphenylhydrazone), 1-naphthalenecarbaldehyde 1-methyl-1-phenylhydrazone, 1-naphthalenecarbaldehyde 1,1-phenylhydrazone, 4-methoxynaphthlene-1-carbaldehyde 1-methyl-1-phenylhydrazone, and the like. Other typical hydrazone transport molecules are described, for example, in U.S. Pat. Nos. 4,150,987; 4,385,106; 4,338,388 and 4,387,147, the disclosures of each of which are totally incorporated herein by reference; carbazole phenyl hydrazone transport molecules such as 9-methylcarbazole-3-carbaldehyde-1,1-diphenylhydrazone, 9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1,1-diphenylhydrazone, and the like, such as those described in U.S. Pat. Nos. 4,256,821 and 4,297,426, the disclosures of each of which are totally incorporated herein by reference. These electrically active small molecule charge transporting compounds are dissolved or molecularly dispersed in electrically inactive polymeric materials. If the transport layer is fabricated employing a charge transporting polymer, the charge transporting moiety can be incorporated in the polymer as a pendant or in the chain, or may form the backbone of the polymer. This type of charge transport polymer includes materials, such as poly(N-vinylcarbazole), polysilylenes, polyaryamines and others, including those described in U.S. Pat. Nos. 4,618,551; 4,806,443; 4,806,444; 4,818,650; 4,935,487 and 4,956,440.

In embodiments of the present invention, a preferred hole transport layer is comprised of components as represented, or essentially represented, by the following general formula

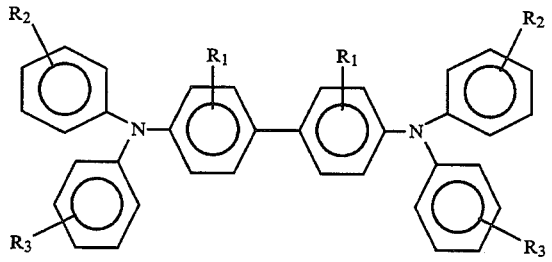

wherein $R_1$, $R_2$ and $R_3$ are selected from the group consisting of hydrogen, an alkyl group with, for example, from 1 to about 25 carbon atoms and a halogen like methyl, ethyl, propyl, butyl, pentyl, hexyl, and the like, preferably chlorine, and at least one of $R_1$, $R_2$ and $R_3$ is independently an alkyl group or chlorine. When $R_2$ and $R_3$ are hydrogen, the compound may be named N,N'-diphenyl-N,N'-bis(alkylphenyl)-[1,1'-biphenyl]-4,4'-diamine wherein the alkyl is, for example, methyl, ethyl, propyl, n-butyl, or the like, or the compound may be N,N'-diphenyl-N,N'-bis(chlorophenyl)-[1,1'-biphenyl]-4,4'-diamine. One of the charge transporting molecules that permits excellent injection of holes from the pigment with high efficiency and transports them across with very short transit times is N,N'-diphenyl-N,N'-bis(3-methylphenyl)-(1,1'-biphenyl)-4,4'-di-amine of the formula

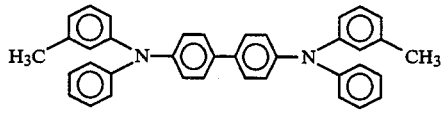

Various suitable and conventional methods may be utilized to mix and thereafter apply the charge transport layer coating mixture to, for example, the charge generating layer. Typical application techniques include spraying, dip coating, roll coating, wire wound rod coating, and the like. Drying of the deposited coating may be effected by any suitable conventional processes such as oven drying, infrared radiation drying, air drying and the like.

Generally, the thickness of the charge transport layer is between about 10 to about 50 micrometers, but thicknesses outside this range may also be used in embodiments. The charge, especially hole, transport layer should be an insulator to the extent that the electrostatic charge placed on this layer is not conducted in the absence of illumination at a rate sufficient to prevent formation and retention of an electrostatic latent image thereon. In general, the ratio of the thickness of the hole transport layer to the charge generator layers is preferably maintained from about 2:1 to 200:1 and in some instances as great as 400:1. Thus, the charge transport layer is substantially nonabsorbing to visible light or radiation in the region of intended use, but is "active" in that it allows the injection of photogenerated holes from the photoconductive layer, that is the charge generation layer, and allows these holes to be transported through itself to selectively discharge a surface charge on the surface of the active layer.

The dopant molecule in the transport layer has hydroxy groups attached to it and in some embodiments is comprised of molecules with the following formulas

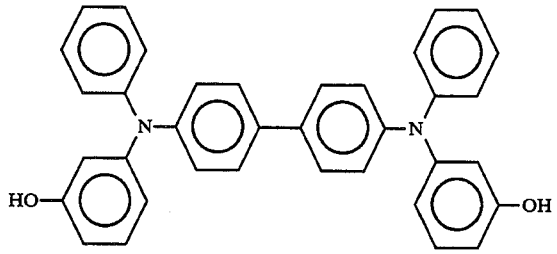

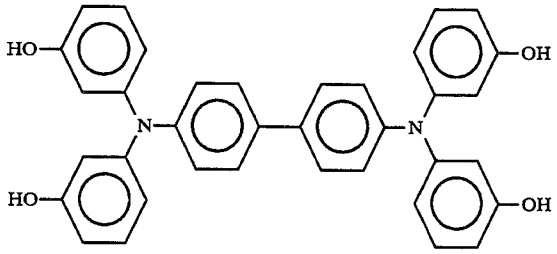

The concentration of the added dopant can vary from, for example, about 0.5 weight percent to about 15 weight percent based on the charge transporting molecules.

The dopant can also be comprised of hydroxy derivatives of other charge transporting molecules, such as hydrazones, oxadiazoles, stilbenes, pyrazolines, and the like.

Although not desired to be limited by theory, it is believed some of the dopant in the transport layer, such as the hydroxy derivative of the charge transporting molecule, enters the generator layer during the transport layer fabrication, attaches itself to the photogenerating pigment and increases either the generation or the injection efficiency thereof.

Other layers may also be selected for the imaging members of the present invention, such as a conventional electrically conductive ground strip along one edge of the belt or drum in contact with the conductive layer, to facilitate connection of the electrically conductive layer of the photoreceptor to ground or to an electrical bias. Ground strips are well known and usually comprise conductive particles dispersed in a film forming binder.

Also, in embodiments an anticurl back coating may be applied to the side of the substrate opposite the photogenerating layer to provide flatness and/or abrasion resistance. These anticurl back coating layers are well known in the art and may comprise thermoplastic organic polymers or inorganic polymers that are electrically insulating or slightly semiconducting.

Specific embodiments of the invention will now be described in detail. These Examples are intended to be illustrative, and the invention is not limited to the materials, conditions, or process parameters set forth in these embodiments. All parts and percentages are by weight unless otherwise indicated. Comparative Examples are also provided.

EXAMPLE I

A photoreceptor or layered imaging member was prepared by forming coatings using conventional processes as illustrated herein on a substrate comprising a vacuum deposited titanium layer on a polyethylene terephthalate film (MELINEX®, available from E.I. DuPont de Nemours & Company). The first deposited coating on the substrate was a siloxane barrier layer formed from hydrolyzed gamma aminopropyl triethoxy silane having a thickness of 100 Angstroms and applied by a Dilts Coater as were the other layers unless otherwise indicated. The second coating deposited on the barrier layer was an adhesive layer of the polyester resin PE 49,000®, available from E.I. DuPont de Nemours & Company having a thickness of 50 Angstroms. The next coating is a charge generator layer containing 35 percent by weight of vanadyl phthalocyanine particles obtained by the process as disclosed in U.S. Pat. No. 4,771,133 (D/87041), the disclosure of which is totally incorporated herein by reference, dispersed in the polyester resin VITEL PE100 TM, 65 weight percent, available from Goodyear Tire and Rubber Company, having a thickness of 1 micrometer. The next layer deposited on the phthalocyanine photogenerator by solution coating was a transport layer and it was coated with a solution containing 1 gram of N,N'-diphenyl-N,N'-bis(3-methyl-phenyl)-(1,1'-biphenyl)-4,4'-diamine and 1 gram of the polycarbonate resin, a poly(4,4'-isopropylidene-diphenylene) carbonate, available as MAKROLON® from Farbenfabricken Bayer A.G., and dissolved in 11.5 grams of methylene chloride solvent using a Bird coating applicator. The N,N'-diphenyl-N,N'-bis(3-methyl-phenyl)-(1,1'-biphenyl)-4,4'-diamine is an electrically active aromatic diamine charge transport small molecule whereas the polycarbonate resin is an electrically inactive film forming binder. The coated device was dried at 80° C. for half an hour in a forced air oven to form a 25 micrometer thick charge transport layer.

EXAMPLE II

A second device or layered imaging member was prepared by essentially repeating the processes of Example I, except that the transport layer was doped with a hydroxy derivative of the charge transporting diamine and was coated as follows. The transport layer was formed from a solution containing 0.95 gram of N,N'-diphenyl-N,N'-bis(3-methyl-phenyl)-(1,1'-biphenyl)-4,4'-diamine, 0.05 gram of N,N'-diphenyl-N,N'-bis(3-hydroxy-phenyl)-(1,1'-biphenyl)-4,4'-diamine, and 1.0 gram of the polycarbonate resin, a poly(4,4'-isopropylidene-diphenylene) carbonate, available as MAKROLON® from Farbenfabricken Bayer A.G., dissolved in 11.5 grams of methylene chloride solvent using a Bird coating applicator. The coated device was dried at 80° C. for half an hour in a forced air oven to form a 25 micrometer thick charge transport layer.

EXAMPLE III

The sensitivities of the devices in Examples I and II were determined as follows. The devices were mounted on a cylindrical aluminum drum which was rotated on a shaft. The device was charged by a corotron mounted along the periphery of the drum. The surface potential was measured as a function of time by capacitively coupled voltage probes placed at different locations around the shaft. The probes were calibrated by applying known potentials to the drum substrate. The devices on the drums were exposed by a light source located at a position near the drum downstream from the corotron. Charging of the photoconductor devices is accomplished by a corotron. As the drum was rotated, the initial (pre-exposure) charging potential was measured by voltage probe. Further, rotation leads to the exposure station where the photoconductor device was exposed to monochromatic radiation of known intensity. The device was erased by light source located at a position prior to charging. The measurement comprised charging the photoconductor device in a constant current or voltage mode with a negative polarity corona. As the drum was rotated, the initial charging potential was measured by a voltage probe 1. Further rotation leads to the exposure station, where the photoconductor device was exposed to monochromatic radiation of known intensity. The surface potential after exposure was measured by voltage probes 2 and 3. The device was finally exposed to an erase lamp of appropriate intensity and any residual potential was measured by a voltage probe 4. The process was repeated with the magnitude of the exposure automatically changed during the next cycle. The photodischarge characteristics was were obtained by plotting the potentials at voltage probes 2 and 3 as a function of light exposure. The charge acceptance and dark decay can also be measured in the scanner. The photodischarge characteristics were measured at an infrared wavelength of 7800 A. The light energy required to discharge the first device from 800 volts to 100 volts was 12 ergs/cm$^2$ whereas for the second device the light energy required to discharge from 800 volts to 100 volts was 6 ergs/cm$^2$, a dramatic increase in sensitivity resulting from the doping with the hydroxy derivative of the transport molecule in the transport layer.

EXAMPLE IV

A third photoreceptor was prepared by forming coatings essentially as described in Example II using techniques described below on a substrate comprising a vacuum deposited titanium layer on a polyethylene terephthalate film, MELINEX®, available from E.I. DuPont de Nemours & Company. The first deposited coating was a siloxane barrier layer formed from hydrolyzed gamma aminopropyl triethoxy silane having a thickness of 100 Angstroms. The second coating was an adhesive layer of polyester resin, PE 49,000®, available from E.I. DuPont de Nemours & Company, having a thickness of 50 Angstroms. The next coating was a charge generator layer containing 75 percent by weight of Type I (or beta) oxytitanium phthalocyanine particles as obtained by the processes of U.S. Pat. No. 5,189,156 and U.S. Pat. No. 5,206,359 and copending application U.S. Pat. No. 024,145, the discloses of which are totally incorporated herein by reference, and 25 weight percent polyvinyl butyral resin with a molecular weight of approximately 150,000 (BMS TM, available from Sekisui Chemical Company of Japan). This layer was fabricated as follows: 0.56 gram of oxytitanium phthalocyanine particles and 0.18 gram of polyvinyl butyral were milled with 20 milliliters of butyl acetate for 24 hours in a glass jar containing steel shot. A film of 0.2 micrometer was coated utilizing a 0.25 mil Bird bar and cured at 100° C. for 10 minutes. The next layer was a transport layer which was coated with a solution containing 1 gram of N,N'-diphenyl-N,N'-bis(3-methyl-phenyl)-(1,1'-biphenyl)-4,4'-diamine and 1 gram of the polycarbonate resin, a poly(4,4'-isopropylidene-diphenylene) carbonate, available as MAKROLON® from Farbenfabricken Bayer A.G., dissolved in 11.5 grams of methylene chloride solvent using a Bird coating applicator. The N,N'-diphenyl-N,N'-bis(3-methyl-phenyl)-(1,1'-biphenyl)-4,4'-diamine was an electrically active aromatic diamine charge transport small molecule whereas the polycarbonate resin was an electrically inactive film forming binder. The coated device was dried at 80° C. for half an hour in a forced air oven to form a 25 micrometer thick charge transport layer.

EXAMPLE V

A fourth device was prepared by repeating the processes of Example IV except that the transport layer was doped with hydroxy derivative of the charge transporting diamine and was coated as follows. The transport layer was coated with a solution containing 0.95 gram of N,N'-diphenyl-N,N'-bis(3-methyl-phenyl)-(1,1'-biphenyl)-4,4'-diamine, 0.05 gram of N,N'-diphenyl-N,N'-bis(3-hydroxy-phenyl)-(1,1'-biphenyl)-4,4'-diamine, and 1 gram of the polycarbonate resin, a poly(4,4'-isopropylidene-diphenylene) carbonate, available as MAKROLON® from Farbenfabricken Bayer A.G., dissolved in 11.5 grams of methylene chloride solvent using a Bird coating applicator. The coated device was dried at 80° C. for half an hour in a forced air oven to form a 25 micrometer thick charge transport layer. A fourth device was coated as in Example II. It was then coated with a 2 micron thick overcoat from a solution containing 0.9 gram of N,N'-diphenyl-N,N'-bis(3-methyl-phenyl)-(1,1'-biphenyl)-4,4'-diamine, 0.1 gram of alphatocopherol and 1 gram of the polycarbonate resin, poly(4,4'-cyclohexylidine-diphenylene) carbonate, dissolved in 23 grams of toluene solvent using a Bird coating applicator. The device was dried in a forced air oven at 80° C. for 30 minutes.

EXAMPLE VI

The third and fourth devices of Examples IV and V are tested for their infrared sensitivities by the processes described in Example III. At a wavelength of 780 nanometers, the light energy required to discharge device 4 (Example V) from 800 volts to 100 volts was found to be 20 percent lower than that required to discharge device 3 (Example IV). The slight doping of the transport layer by the hydroxy derivative has thus increased the photosensitivity significantly.

EXAMPLE VII

Device 5 is fabricated as in Example IV except that oxytitanium phthalocyanine is replaced by chlorogallium phthalocyanine. Device 4 is fabricated as in Example V except oxytitanium phthalocyanine is replaced by chlorogallium phthalocyanine. On testing for sensitivity, device 5 was found to be 60 percent more sensitive, a significant increase in sensitivity as a result of the doping of the transport layer by the hydroxy derivative.

EXAMPLE VIII

Three devices with the same generator layers but different transport layers were fabricated as in Example II. The photoreceptors were prepared by forming coatings using conventional techniques on a substrate comprising a vacuum deposited titanium layer on a polyethylene terephthalate film, MELINEX®, available from E.I. DuPont de Nemours & Company. The first deposited coating is a siloxane barrier layer formed from hydrolyzed gamma aminopropyl triethoxy silane having a thickness of 100 Angstroms. The second coating is an adhesive layer of polyester resin, PE 49,000®, available from E.I. DuPont de Nemours & Company, having a thickness of 50 Angstroms. The next coating is a charge generator layer containing 35 percent by weight of vanadyl phthalocyanine particles obtained by the process as disclosed in U.S. Pat. No. 4,771,133 (D/87041), the disclosure of which is totally incorporated herein by reference, dispersed in a polyester resin, VITEL PE100 TM, available from Goodyear Tire and Rubber Company, having a thickness of 1 micrometer. The first of these three generator layers was coated with a transport layer of a solution containing 1 gram of tris(4-methyl phenyl)amine and 1 gram of polycarbonate resin, a poly(4,4'-isopropylidene-diphenylene) carbonate, available as MAKROLON® from Farbenfabricken Bayer A. G., and dissolved in 11.5 grams of methylene chloride solvent using a Bird coating applicator. The second of the three generator layers was coated with transport layer of a solution containing 0.9 gram of tris(4-methyl phenyl)amine, 0.1 gram of N,N'-di(3-hydroxyphenyl)-p-toluidine and 1 gram of polycarbonate resin, a poly(4,4'-isopropylidene-diphenylene) carbonate, available as MAKROLON® from Farbenfabricken Bayer A.G., and dissolved in 11.5 grams of methylene chloride solvent using a Bird coating applicator. The third of the three generator layers was coated with a solution containing 0.9 gram of tris(4-methyl phenyl)amine, 0.1 gram of N,N'-diphenyl-N,N'-bis(3-hydroxy-phenyl)-(1,1'-biphenyl)-4,4'-diamine and 1 gram of polycarbonate resin, a poly(4,4'-isopropylidene-diphenylene) carbonate, available as MAKROLON® from Farbenfabricken Bayer A. G., and dissolved in 11.5 grams of methylene chloride solvent using a Bird coating applicator. After the transport layer coating, the three devices were dried at 80° C. for half an hour in a forced air oven to form 25 micrometer thick charge transport layers. The devices were tested for their sensitivities by the technique described in Example III. An increase in sensitivity by factor of 2 was observed for the second and third devices as compared to the first device. The sensitivity increase manifested as a reduction in light energy required to discharge the device from 800 volts to 100 volts.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. An imaging member comprising a supporting substrate, a photogenerating layer and a charge transport layer, said charge transport layer comprising charge transporting molecules dispersed in a polymeric binder and wherein said transport layer contains a hydroxy derivative of said charge transport molecules; and wherein said hydroxy derivative is an aryl amine selected from the group consisting of

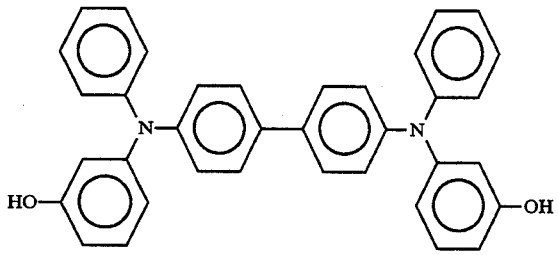

and

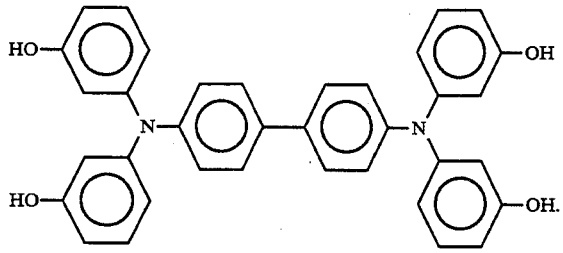

2. An imaging member in accordance with claim 1 wherein the photogenerating layer is comprised of metal free phthalocyanines, metal phthalocyanines, vanadyl phthalocyanines, oxytitanium phthalocyanines, chlorogallium phthalocyanines, hydroxygallium phthalocyanines, or mixtures thereof.

3. An imaging member in accordance with claim 1 wherein the photogenerating layer is comprised of photogenerating pigments dispersed in an inactive resin binder.

4. An imaging member in accordance with claim 3 wherein the photogenerating pigment is titanyl phthalocyanine.

5. An imaging member in accordance with claim 1 wherein the charge transport layer is comprised of aryl amine charge transport components dispersed in an inactive resin binder.

6. An imaging member in accordance with claim 1 wherein the charge transport layer components are present in an amount of from about 25 to about 60 weight percent of the combined weight of the charge transport component and the polymeric binder.

7. An imaging member in accordance with claim 1 wherein the hydroxy derivative of the charge transport molecules is present in an amount of from 1 to about 15 weight percent based on the weight of the transport molecules.

8. An imaging member in accordance with claim 1 wherein the hydroxy derivative is present in an amount of 5 weight percent based on the weight of the charge transport components.

9. An imaging member in accordance with claim 1 wherein the photogenerator layer is situated between the substrate and the charge transport layer.

10. An imaging member in accordance with claim 1 wherein the supporting substrate is comprised of a conductive substrate comprised of a metal.

11. An imaging member in accordance with claim 1 wherein the photogenerator layer has a thickness of from about 0.05 to about 10 microns.

12. An imaging member in accordance with claim 1 wherein the photogenerating compound is dispersed in a resinous binder in an amount of from about 5 percent by weight to about 95 percent by weight.

13. An imaging member in accordance with claim 12 wherein the charge transport layer comprises aryl amine molecules.

14. An imaging member in accordance with claim 13 wherein the aryl amine is of the formula

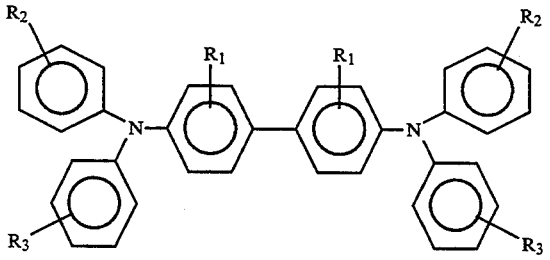

wherein $R_1$, $R_2$ and $R_3$ are selected from the group consisting of hydrogen, an alkyl group with from 1 to about 25 carbon atoms and a halogen, and at least one of $R_1$, $R_2$ and $R_3$ is independently an alkyl group or halogen.

15. An electrophotographic imaging member in accordance with claim 1 wherein the charge transport layer has a thickness of between about 5 micrometers and about 50 micrometers.

16. A method of imaging which comprises generating an electrostatic latent image on the imaging member of claim 1, developing the latent image, and transferring the developed electrostatic image to a suitable substrate.

17. A method of imaging which comprises generating an electrostatic latent image on an imaging member of claim 7, developing the latent image, and transferring the developed electrostatic image to a suitable substrate.

18. A method of imaging which comprises generating an electrostatic latent image on an imaging member of claim 14, developing the latent image, and transferring the developed electrostatic image to a suitable substrate.

19. A process for increasing the electrical photosensitivity of layered imaging members which comprises adding to the charge transport layer of such members a hydroxy aryl amine of the formula

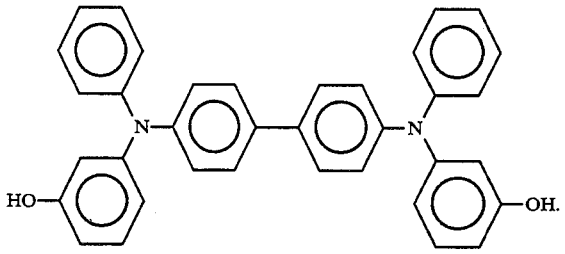

20. A process for increasing the electrical photosensitivity of layered imaging members which comprises adding to the charge transport layer of such members a hydroxy aryl amine of the formula

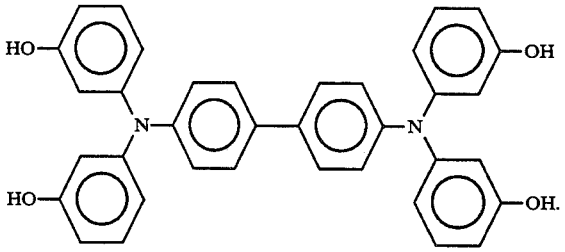

21. A process in accordance with claim 19 wherein the charge transport layer comprises aryl amine molecules of the following formula

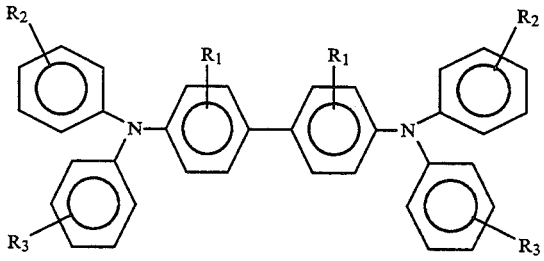

wherein $R_1$, $R_2$ and $R_3$ are selected from the group consisting of hydrogen, an alkyl group with from 1 to about 25 carbon atoms and a halogen, and at least one of $R_1$, $R_2$ and $R_3$ is independently an alkyl group or halogen.

22. A process in accordance with claim 20 wherein the charge transport layer comprises aryl amine molecules of the following formula

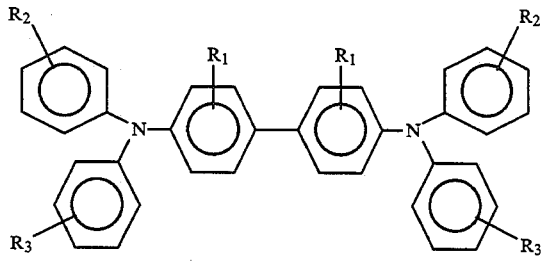

wherein $R_1$, $R_2$ and $R_3$ are selected from the group consisting of hydrogen, an alkyl group with from 1 to about 25 carbon atoms and a halogen, and at least one of $R_1$, $R_2$ and $R_3$ is independently an alkyl group or halogen.

23. An imaging member in accordance with claim 1 wherein the charge transport layer is comprised of molecules N,N'-diphenyl-N,N'-bis(3-methyl-phenyl)-(1,1'-biphenyl)-4,4'-diamine components, and the hydroxy derivative is N,N'-diphenyl-N,N'-bis(3-hydroxyphenyl)-1,1'-biphenyl)-4,4'-diamine.

24. An imaging member consisting essentially of a supporting substrate, a photogenerating layer and a charge transport layer, said charge transport layer comprising charge transporting molecules dispersed in a polymeric binder and wherein said transport layer contains a hydroxy derivative of said charge transport molecules, and wherein said hydroxy derivative is an aryl amine selected from the group consisting of

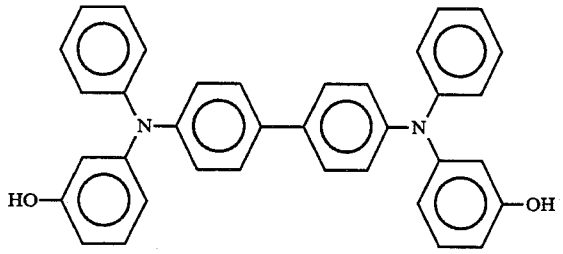

and

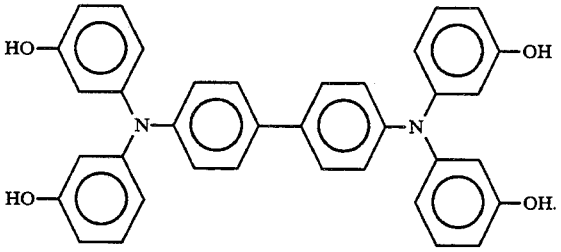

25. An imaging member in accordance with claim 1 wherein the hydroxy derivative is present as a dopant in an amount of from about 0.5 weight percent to about 15 weight percent.

* * * * *